US011000754B2

(12) United States Patent
Gotti

(10) Patent No.: US 11,000,754 B2
(45) Date of Patent: May 11, 2021

(54) FACE PROTECTION ACCESSORY FOR HELMETS AND HELMET PROVIDED WITH SUCH FACE PROTECTION ACCESSORY

(71) Applicant: KASK S.p.A., Chiuduno (IT)

(72) Inventor: Angelo Gotti, Nembro (IT)

(73) Assignee: KASK S.P.A., Chiuduno (IT)

( * ) Notice: Subject to any disclaimer, the term of this patent is extended or adjusted under 35 U.S.C. 154(b) by 356 days.

(21) Appl. No.: 15/334,751

(22) Filed: Oct. 26, 2016

(65) Prior Publication Data

US 2017/0112224 A1 Apr. 27, 2017

(30) Foreign Application Priority Data

Oct. 27, 2015 (IT) ..... 102015000065979

(51) Int. Cl.
*A63B 71/10* (2006.01)
*A42B 3/22* (2006.01)

(52) U.S. Cl.
CPC ..... *A63B 71/10* (2013.01); *A42B 3/225* (2013.01)

(58) Field of Classification Search
CPC ..... A63B 71/10; A42B 3/225; A42B 3/221; A42B 3/227; A42B 3/222; A42B 3/22; A42B 3/20; F16B 21/02; A61F 9/065; A61F 9/06
USPC .... 2/424, 9, 427, 6.3, 15, 8.2, 6.4, 6.7, 429, 2/10; 411/349; 292/218, 241; 24/578.1, 24/663
See application file for complete search history.

(56) References Cited

U.S. PATENT DOCUMENTS 3,123,389 A * 3/1964 Biesecker ..... F16B 5/10 292/218
4,764,989 A 8/1988 Bourgeois
5,970,514 A * 10/1999 Wang-Lee ..... A61F 9/045 2/10
6,102,033 A * 8/2000 Baribeau ..... A62B 18/08 128/201.15
6,199,214 B1 3/2001 Campbell
6,264,392 B1 7/2001 Wise
(Continued)

FOREIGN PATENT DOCUMENTS

AU 3923468 A 12/1970
JP S6373323 U 5/1988
JP 2003064523 A 3/2003

OTHER PUBLICATIONS

Italian Search Report for Italian Application No. IO 59813 (2 Pages) (dated Jul. 6, 2016).

(Continued)

*Primary Examiner* — Nathan E Durham
*Assistant Examiner* — Abby M Spatz
(74) *Attorney, Agent, or Firm* — Lucas & Mercanti, LLP

(57) ABSTRACT

A face protection accessory for work or sports protective helmets is disclosed. The accessory has a support structure having two engagement portions for its engagement to an outer surface of a helmet and a face protection structure, transparent or perforated, to allow a user wearing the helmet to see through the latter. The face protection structure is engageable to the support structure and is removable from the support structure to remove the face protection structure from the helmet or to replace the face protection structure with another different face protection structure.

8 Claims, 16 Drawing Sheets

(56) References Cited

U.S. PATENT DOCUMENTS

| | | | | |
|---|---|---|---|---|
| 6,718,559 | B1 * | 4/2004 | Davidson | A42B 3/0406 2/209.13 |
| 8,214,920 | B1 * | 7/2012 | Edgar | A42B 3/225 2/422 |
| 2008/0189836 | A1 * | 8/2008 | Goodhand | A42B 3/22 2/424 |
| 2009/0241240 | A1 | 10/2009 | Han | |
| 2009/0293180 | A1 | 12/2009 | Grau | |
| 2011/0265236 | A1 | 11/2011 | Stoll | |
| 2012/0144565 | A1 | 6/2012 | Huh | |
| 2012/0291173 | A1 | 11/2012 | Gleason | |
| 2014/0053307 | A1 | 2/2014 | Cheng | |
| 2014/0259286 | A1 | 9/2014 | Boyle | |
| 2014/0345037 | A1 * | 11/2014 | McKinney | A42B 3/227 2/424 |
| 2015/0059057 | A1 | 3/2015 | Pfanner | |
| 2015/0089778 | A1 * | 4/2015 | Tisol, Jr. | F16B 21/02 24/663 |

OTHER PUBLICATIONS

Italian Search Report for Italian Application No. IO 59814 (2 Pages) (dated Jul. 6, 2016).
International Search Report for Italian Application No. IO59734 (2 Pages) (dated Jul. 6, 2016).
International Search Report for Italian Application No. IO 59765 (2 Pages) (dated Jul. 8, 2016).
International Search Report for Italian Application No. IO 59754 (2 Pages) (dated Jul. 8, 2016).

* cited by examiner

FACE PROTECTION ACCESSORY FOR HELMETS AND HELMET PROVIDED WITH SUCH FACE PROTECTION ACCESSORY

CROSS-REFERENCE TO RELATED APPLICATION

This application claims the benefit of Italian Patent Application No. 102015000065979 filed Oct. 27, 2015, the contents of which are incorporated herein by reference.

BACKGROUND OF THE INVENTION

The present invention relates to a face protection accessory for helmets, in particular work or sports protective helmets, according to the present invention.

It is also an object of the present a helmet, in particular work or sports protective helmet, provided with such face protection accessory.

The object of the present invention belongs to the field of helmets, headpieces and/or similar safety protective headgears which can be used during the performing of dangerous and risky activities, such as those carried out in construction sites, mines, oil platforms, by fire-fighters, by first aid providers, by mountain climbers or those carried out in any field where it is necessary to protect the head of the users.

The object of the present invention is also suitable to be applied in the field of sports helmets, such as for example those intended for cycling, riding, skiing and for any other sports activity requiring the use of helmets.

As known, work protective helmets generally comprise a structure having at least one convex outer surface and at least one concave inner surface adapted to receive in engagement a user's head.

The inner surface is usually provided with a polystyrene protective shell for absorbing bumps and with possible paddings intended to improve the fit thereof.

The above mentioned helmets can be provided with various accessories arranged on them according to the specific needs.

A particular type of accessory which is often arranged on work, as well as on sport helmets, is the face protection accessory, such as for example the visor, the mask, the tinted mask, the net and similar.

Each accessory has its own form and structure and, in some cases, it is integrally associated to the helmet, so that it cannot be separated therefrom, while in other cases it can be temporarily applied on the same by means of known engagement mechanisms.

In case different tasks need to be performed, thus requiring the use of different face protection accessories, it is necessary to be equipped with a helmet integral with the corresponding accessory for every need, or with a set of face protection accessories to be applied to a suitable helmet, according to the specific needs.

In case the face protection accessories are integral with the helmets, the fact of being equipped with a helmet for every specific task to be performed causes a series of inconveniences of practical and logistic nature.

Firstly, the encumbrance of helmets with integral accessories are considerable, so that it is difficult transporting them for use, as well as storing them when not in use.

With reference, on the other hand, to helmets provided with face protection accessories that can be mounted and disassembled according to needs, the Applicant found that these are yet not free of some inconveniences, and can be improved in many aspects, mainly regarding the overall encumbrance of each face protection accessory, as well as the space needed for the transport and the storage of the same.

In particular, the Applicant found that the face protection accessories which can be applied on suitable helmets have bulky engagement portions intended for coupling to the above mentioned helmets. As a consequence, the greater the number of face protection accessories that need to be equipped, the more is the space needed for the transport and the storage of such face protection accessories.

SUMMARY AND OBJECTS OF THE INVENTION

The main purpose of the present invention is to provide a face protection accessory for helmets, in particular work or sports protective helmet, and a helmet provided with such face protection accessory in order to solve the problems observed in the known technique.

It is a purpose of the present invention to further reduce the encumbrance of the face protection accessories.

It is also a purpose of the present invention to reduce the spaces needed for the transport and the storage of such face protection accessories.

The above specified and yet further purposes are substantially achieved by a face protection accessory for helmets, in particular work or sports protective helmet, and a helmet provided with such face protection accessory, as stated and described in the following claims.

There is now provided, by way of example the description of a preferred but not exclusive embodiment of a face protection accessory for helmets, in particular work or sports protective helmet, and a helmet provided with such face protection accessory, as stated and described in the following claims.

BRIEF DESCRIPTION OF THE DRAWINGS

Such description will be made herein below with reference to the accompanying drawings, provided for indicative purposes only and therefore not limiting, wherein.

DETAILED DESCRIPTION OF THE INVENTION

Figure 1:
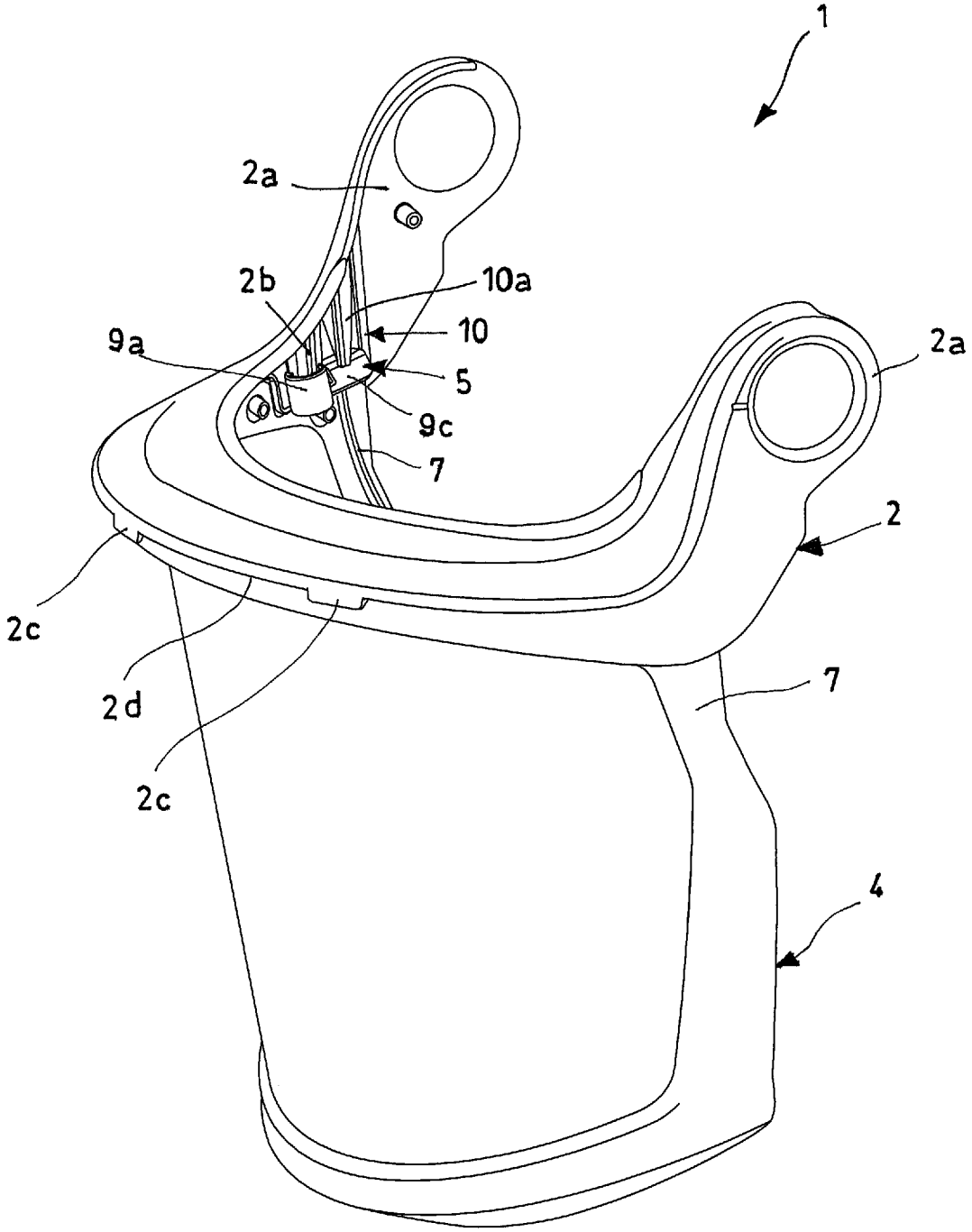
FIG. 1 is a perspective view of a face protection accessory for helmets, in particular work or sports protective helmets, according to the present invention.
Figure 2:
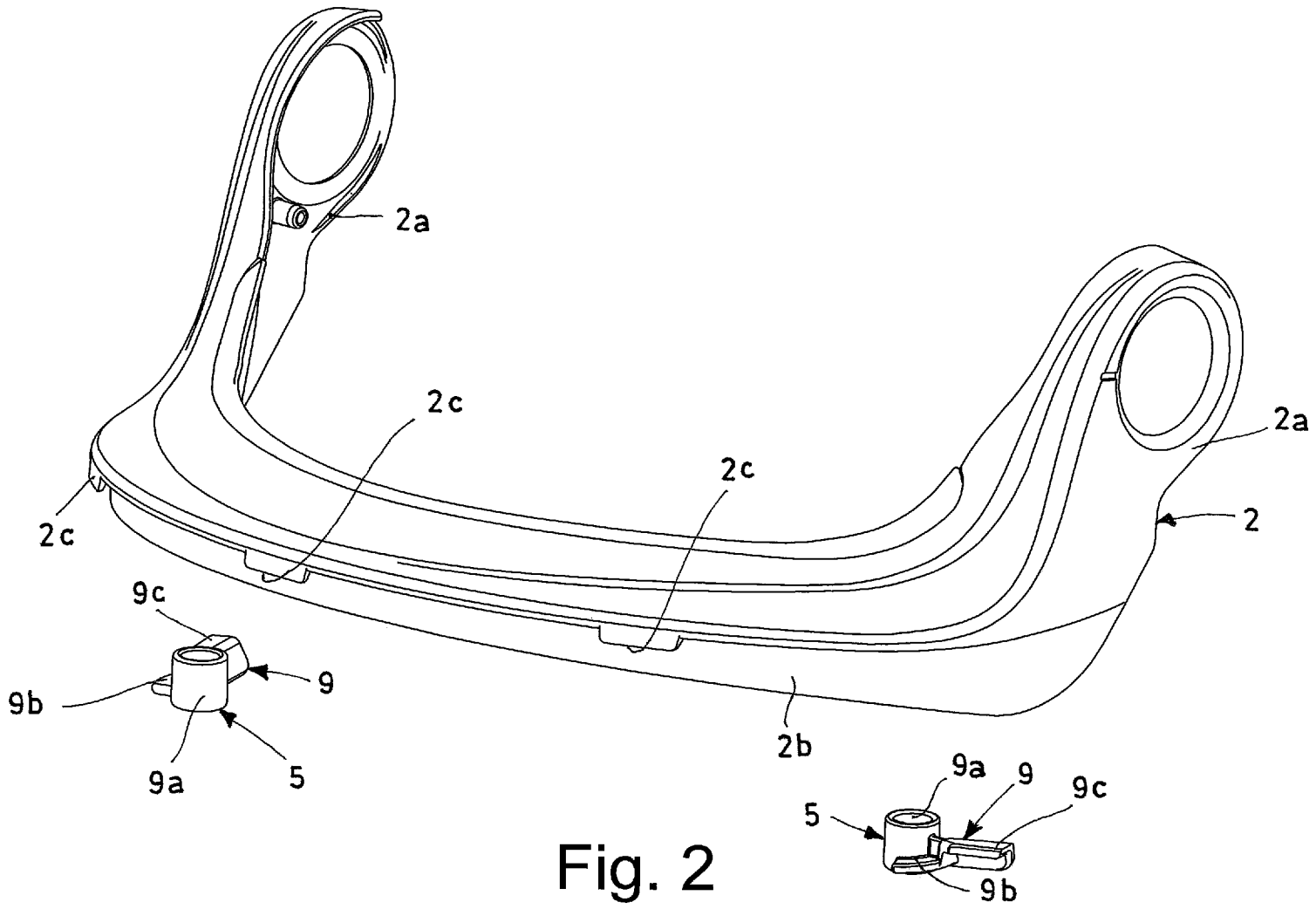
FIG. 2 is a perspective exploded view of some components of the face protection accessory of FIG. 1.
Figure 3:
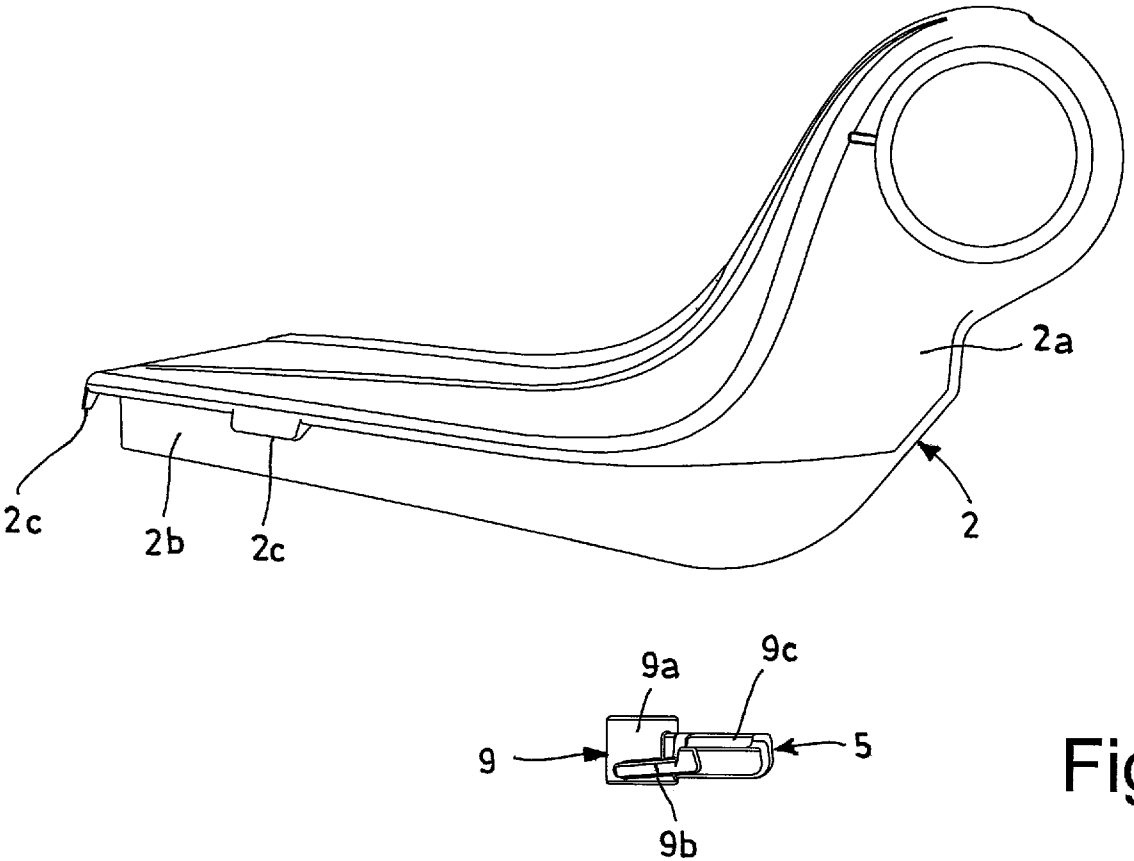
FIG. 3 is a lateral exploded view of the components of the face protection accessory represented in FIG. 2.
Figure 4:
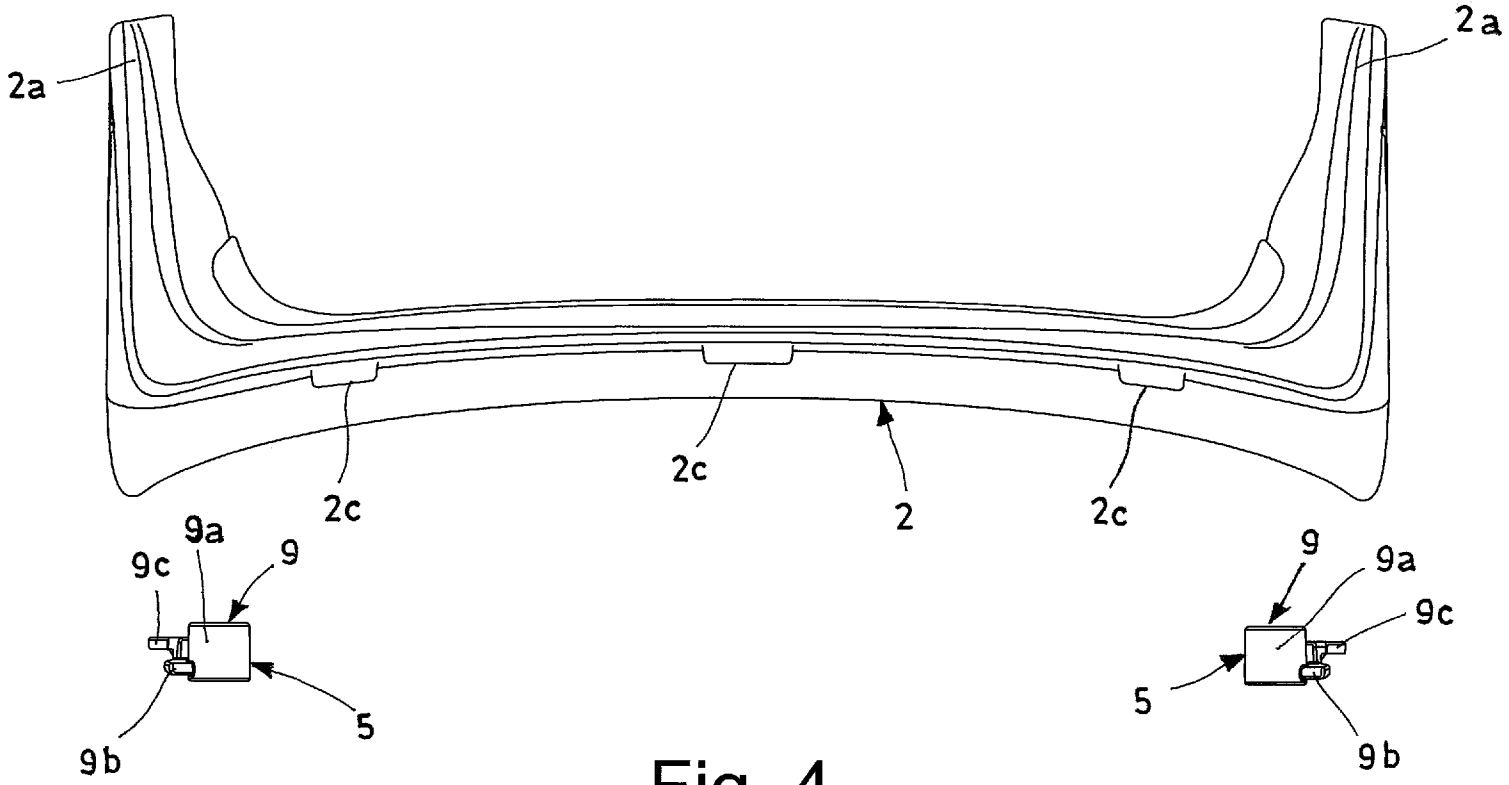
FIG. 4 is a front exploded view of the components of the face protection accessory represented in FIGS. 2 and 3.

With reference to FIG. 1, number 1 wholly indicates a face protection accessory for helmets, in particular work or sports protective helmets, according to the present invention.

The face protection accessory 1 comprises at least a support structure 2 having two portions 2*a* for the engagement to an outer surface 3*a* of a helmet 3 and at least a face protection structure 4, a net or a similar transparent or perforated accessory, such as for example a visor, a mask, a tinted mask, a net, or similar, in order to allow a user wearing such helmet 3 to see through the same.

Advantageously, the face protection structure 4 can be engaged to the support structure 2 to form the face protection accessory 1 and it can be removed from the support structure 2 to allow the removal of the face protection structure 4 from the helmet 3 or to replace the face protection structure 4 with another different face protection structure 4.

Figure 11:
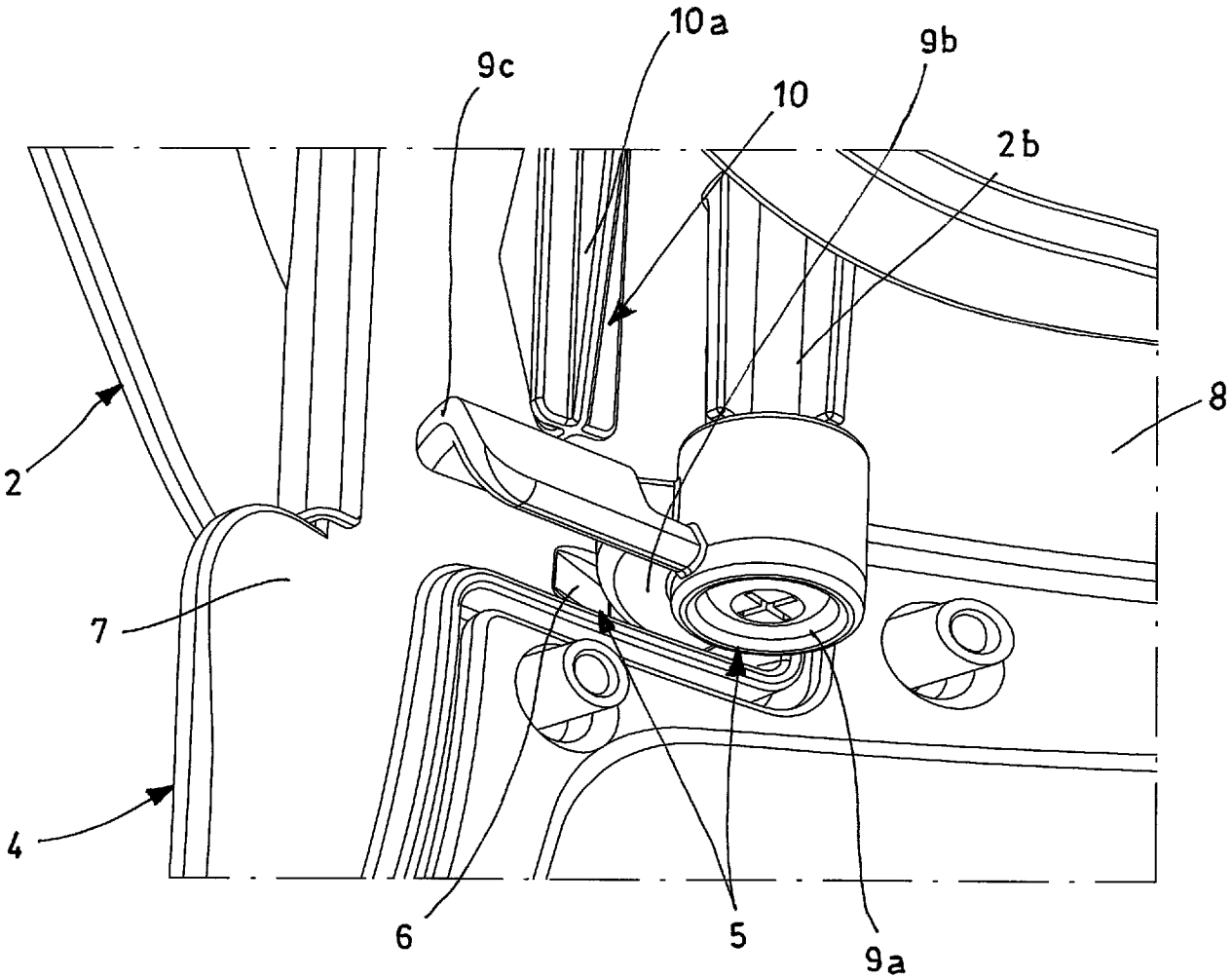
Figure 12:
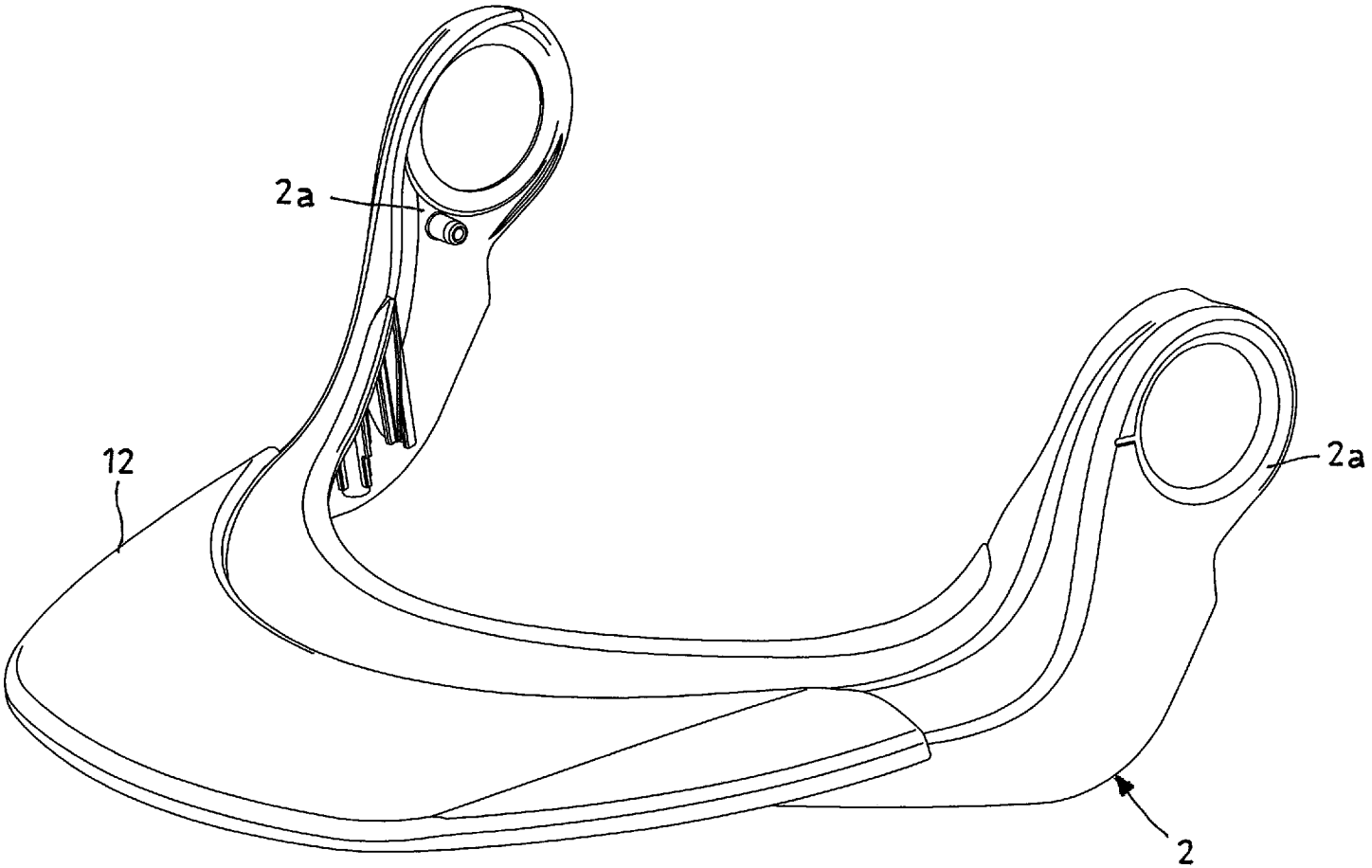
FIG. 12 is a perspective view of a component of the face protection accessory of FIG. 1 with a further component assembled.
Figure 13:
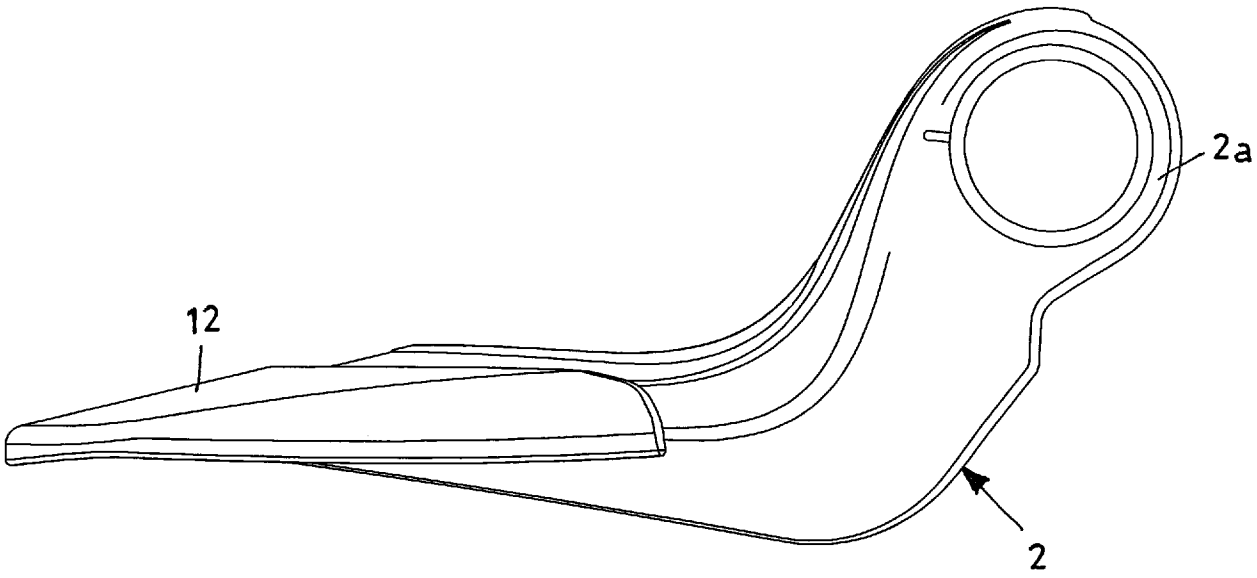
FIG. 13 is a lateral view of the components illustrated in FIG. 12.
Figure 14:
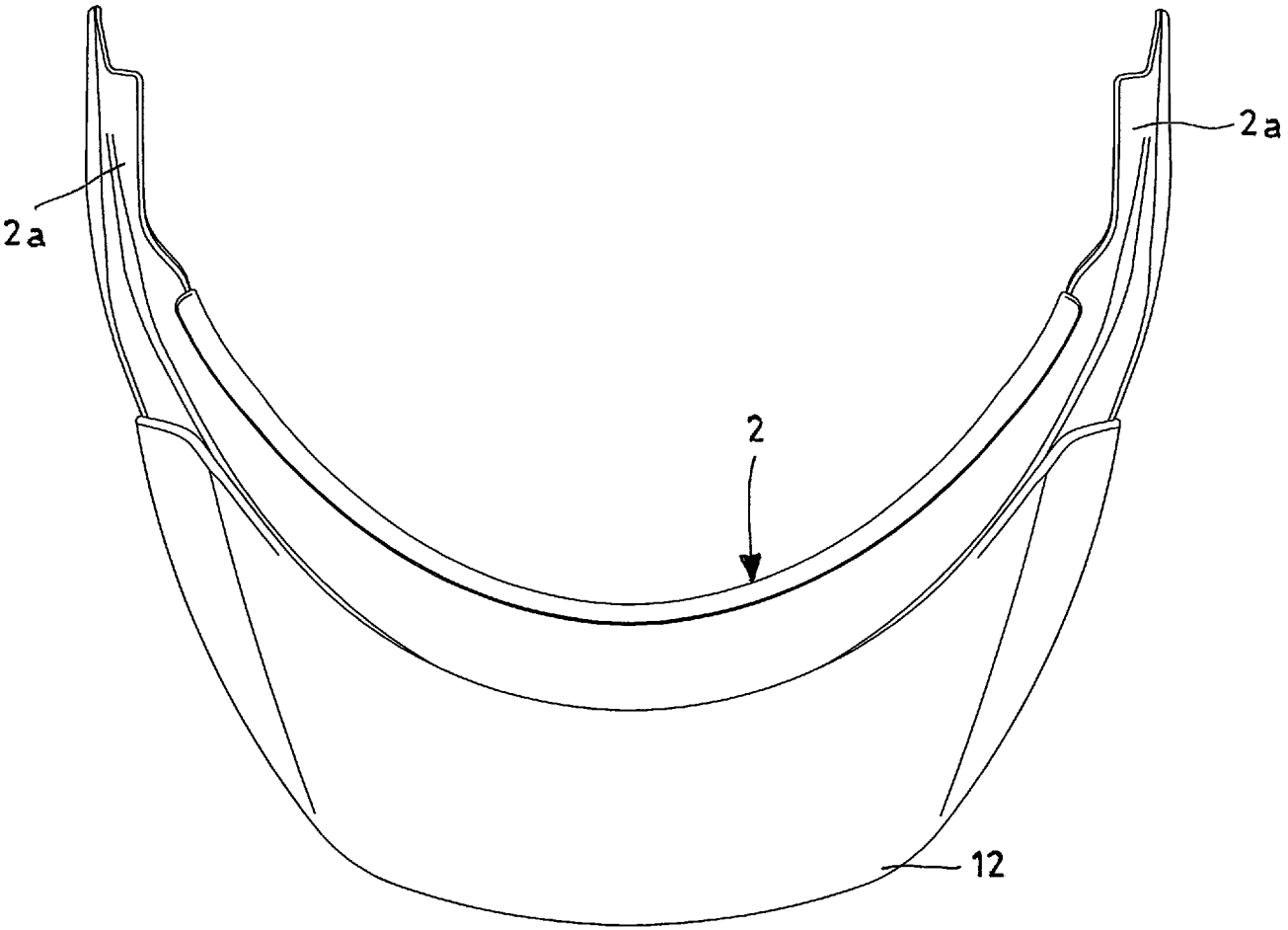
FIG. 14 is a top view of the components illustrated in FIGS. 12 and 13.
Figure 15:
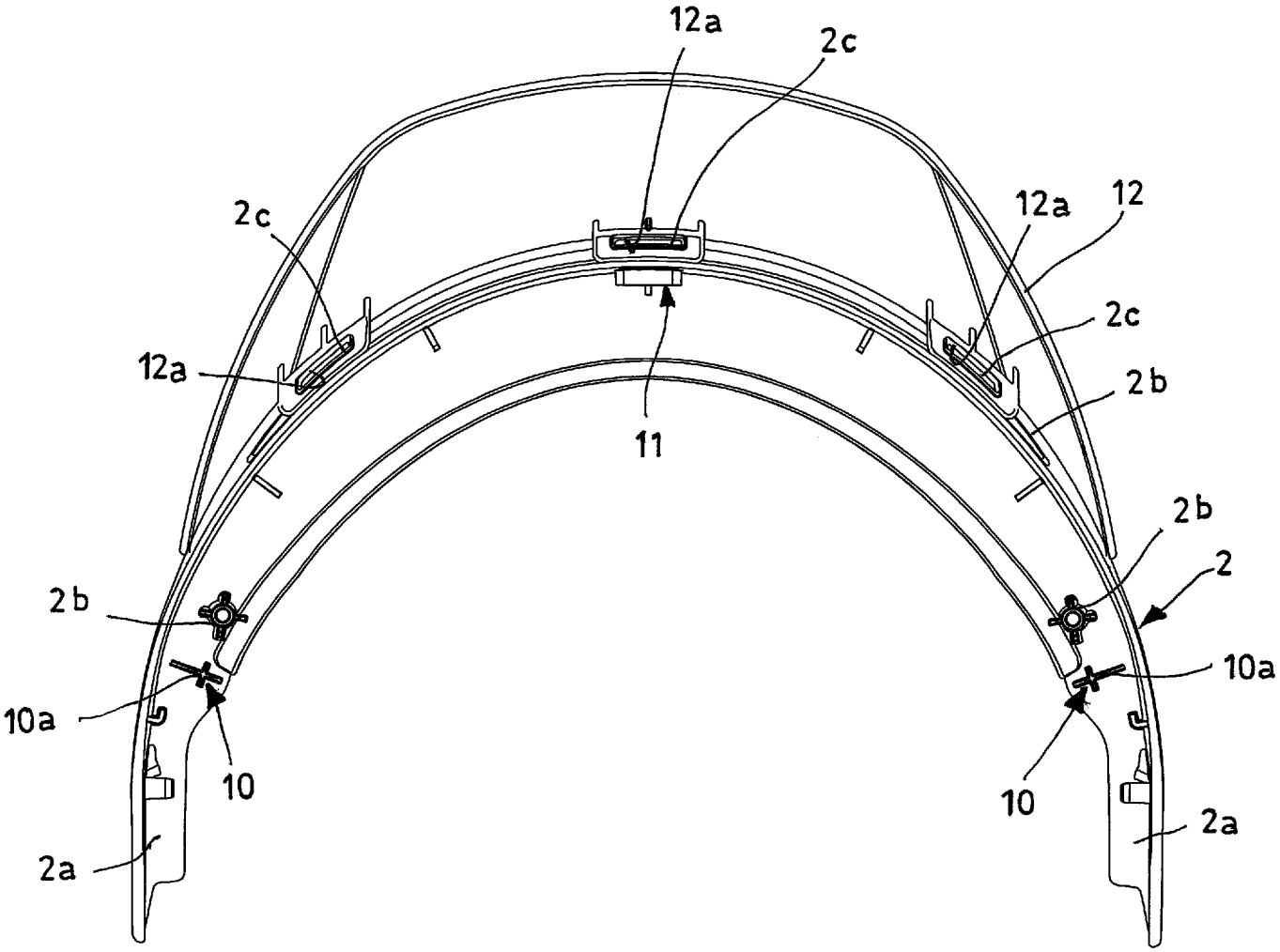
FIG. 15 is a bottom view of the components illustrated in FIGS. 12 to 14.

Preferably, the face protection accessory 1 comprises coupling means 5 (FIGS. 2 to 11) operatively interposed between the support structure 2 and the face protection structure 4. The coupling means 5 are switchable between a first condition (FIG. 11), in which they maintain the support structure 2 and the respective face protection structure 4 mutually engaged, and a second condition (FIGS. 1 to 10), in which they do not maintain the support structure 2 and the respective face protection structure 4 mutually engaged, thus the latter being separable one from another.

In detail, the coupling means 5 comprise at least two coupling seats 6 (FIGS. 7 to 11) each obtained at opposite ends 7 (FIGS. 1, 7 to 11, 16 and 17) of an engagement edge 8 (FIGS. 7 to 11) of the face protection structure 4, preferably of the upper edge of the latter.

The coupling means 5 further comprise at least two coupling pins 9 (FIGS. 1 to 6 and 9 to 11), each moveable preferably independently from the other between a first position (FIGS. 1, 6, 9 and 10), in which it does not engage the respective coupling seat 6 of the face protection structure 4, and a second position (FIGS. 5 and 11), in which it is inserted in the respective coupling seat 6 of the face protection structure 4 so that the face protection structure 4 cannot move with respect to the support structure 2.

In detail, each coupling pin 9 is rotatably moveable between the first and the second position.

As seen in FIGS. 1 to 5 and 9 to 11, each coupling pin 9 comprises at least a hollow cylindrical body 9*a* fitted on a cylindrical support 2*b* (FIGS. 1, 9 to 11 and 15) projecting from the support structure 2. The hollow cylindrical body 9*a* of each coupling pin 9 rotates freely on the respective cylindrical support 2*b* of the support structure 2 about its own longitudinal axis.

From the hollow cylindrical body 9*a* of each coupling pin 9 at least one coupling portion 9*b* (FIGS. 2 to 5 and 9 to 11) projects in a transverse manner, which develops in a circular manner, preferably according to a predetermined circular sector, about such hollow cylindrical body 9*a*. The coupling portion 9*b* of each coupling pin 9 of the coupling means 5 is configured to be inserted inside the respective coupling seat 6 of the face protection structure 4 when the latter is moved from the first to the second position, and to be removed from such coupling seat 6 through the rotation of the hollow cylindrical body 9*a* on the cylindrical support 2*b* of the support structure 2 when the coupling pin 9 is moved from the second to the first position. The coupling portion 9*b* of each coupling pin 9 advantageously extends according to a circular sector comprised between 0° and 180°, more preferably comprised between 60° and 120°, even more preferably of about 90°.

Each coupling pin 9 of the coupling means 5 comprises at least one driving portion 5*c* for moving the same, preferably manually, between the first and the second position. The driving portion 9*c* of each coupling pin 9 projects transversely and radially from the respective hollow cylindrical body 9*a* and has at least one contact surface for manually actuating the respective coupling pin 9 between the first and the second position. Preferably, the driving portion 9*c* of each coupling pin 9 is integrally joined to at least one part of the coupling portion 9*b* of the respective coupling pin 9 opposite to the part that first engages the respective coupling seat 6 of the face protection structure 4 when the coupling pin is switched from the first to the second position.

Advantageously, for each coupling pin 9 of the coupling means 5 corresponding locking means 10 (FIGS. 1, 5, 9 to 11 and 15) are provided, which maintain the respective coupling pin 9 in the second position ensuring that the face protection structure 4 is held on the support structure 2.

Figure 5:
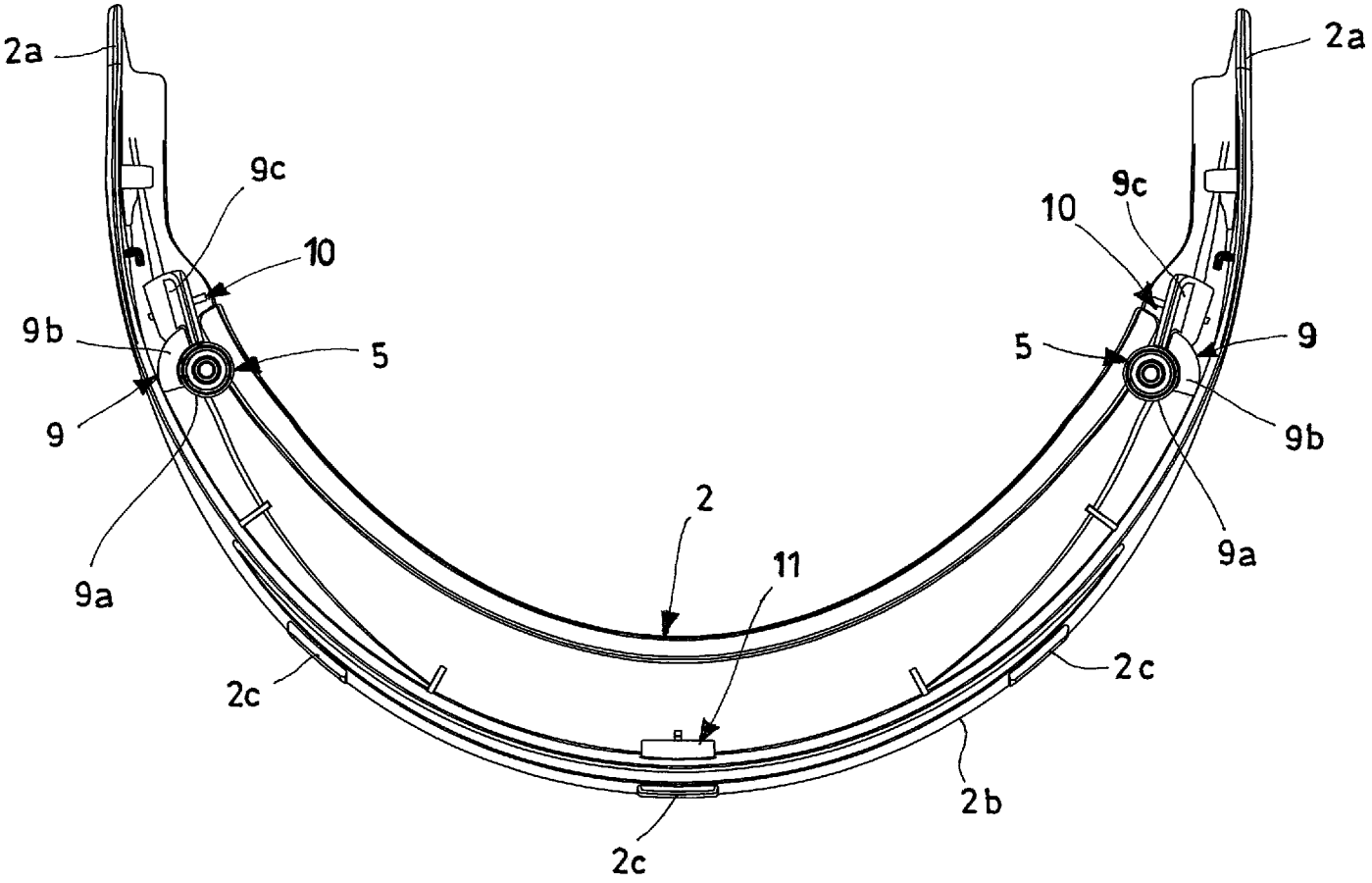
FIG. 5 is a bottom view of the components represented in FIGS. 2 to 4, in assembled configuration.
Figure 6:
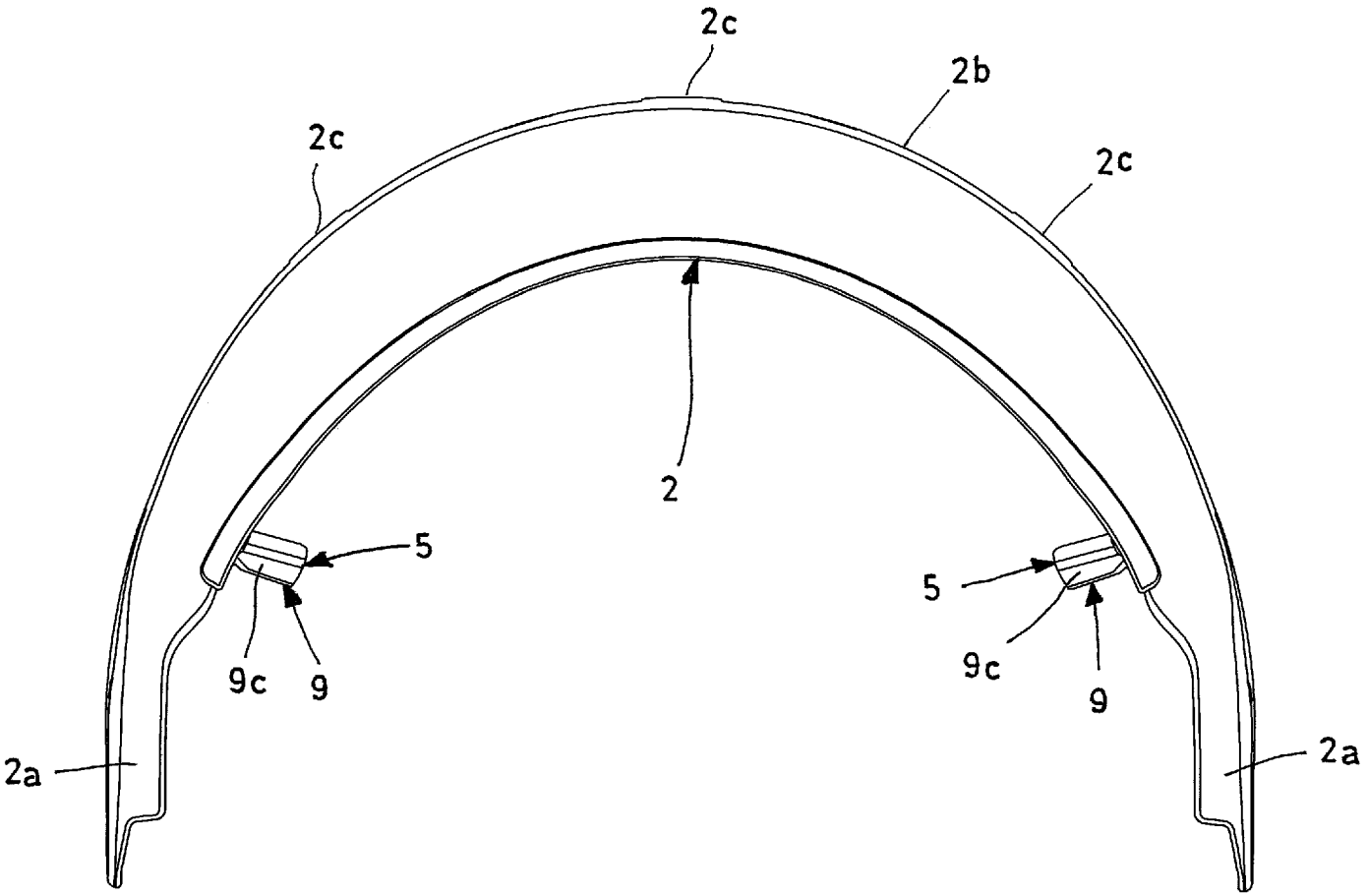
FIG. 6 is a top view of the components represented in FIGS. 2 to 4, in assembled configuration.
Figure 7:
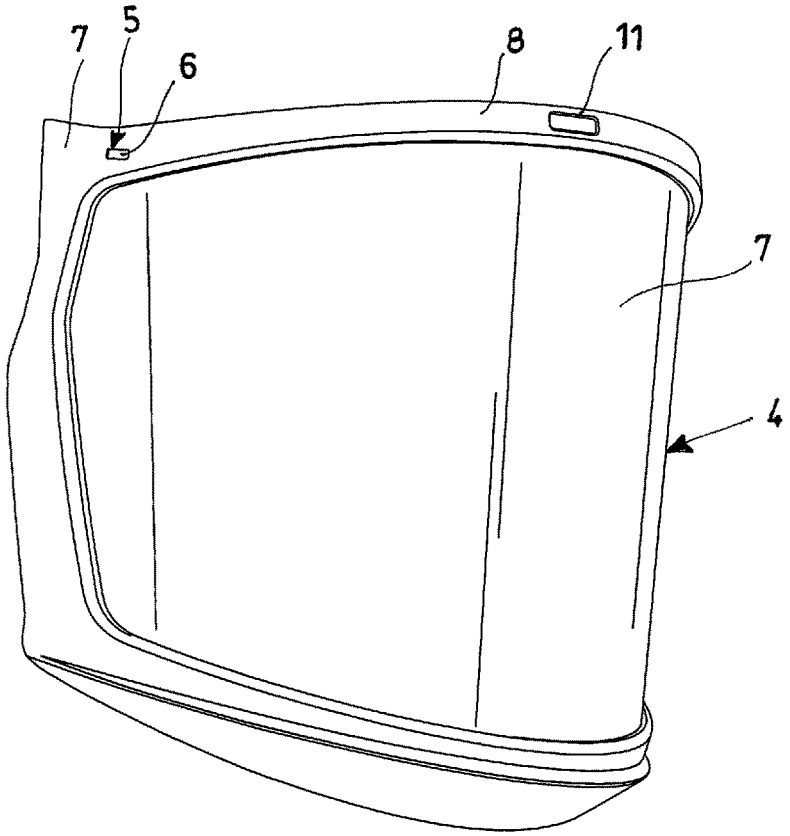
FIG. 7 is a perspective view of a further component of the face protection accessory illustrated in FIG. 1.
Figure 8:
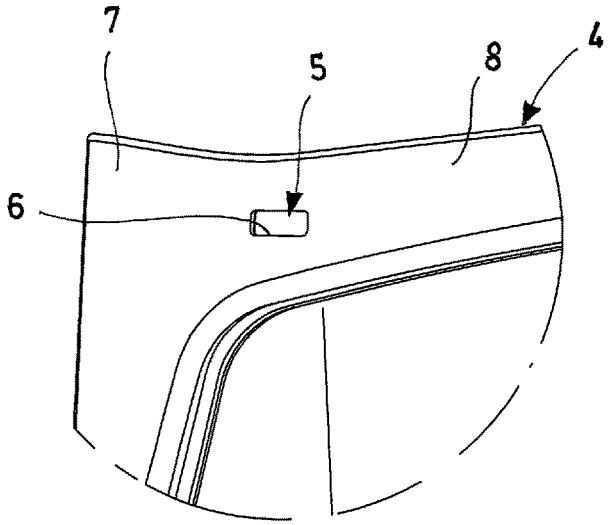
FIG. 8 is a view of a detail of the component of FIG. 7.
Figure 9:
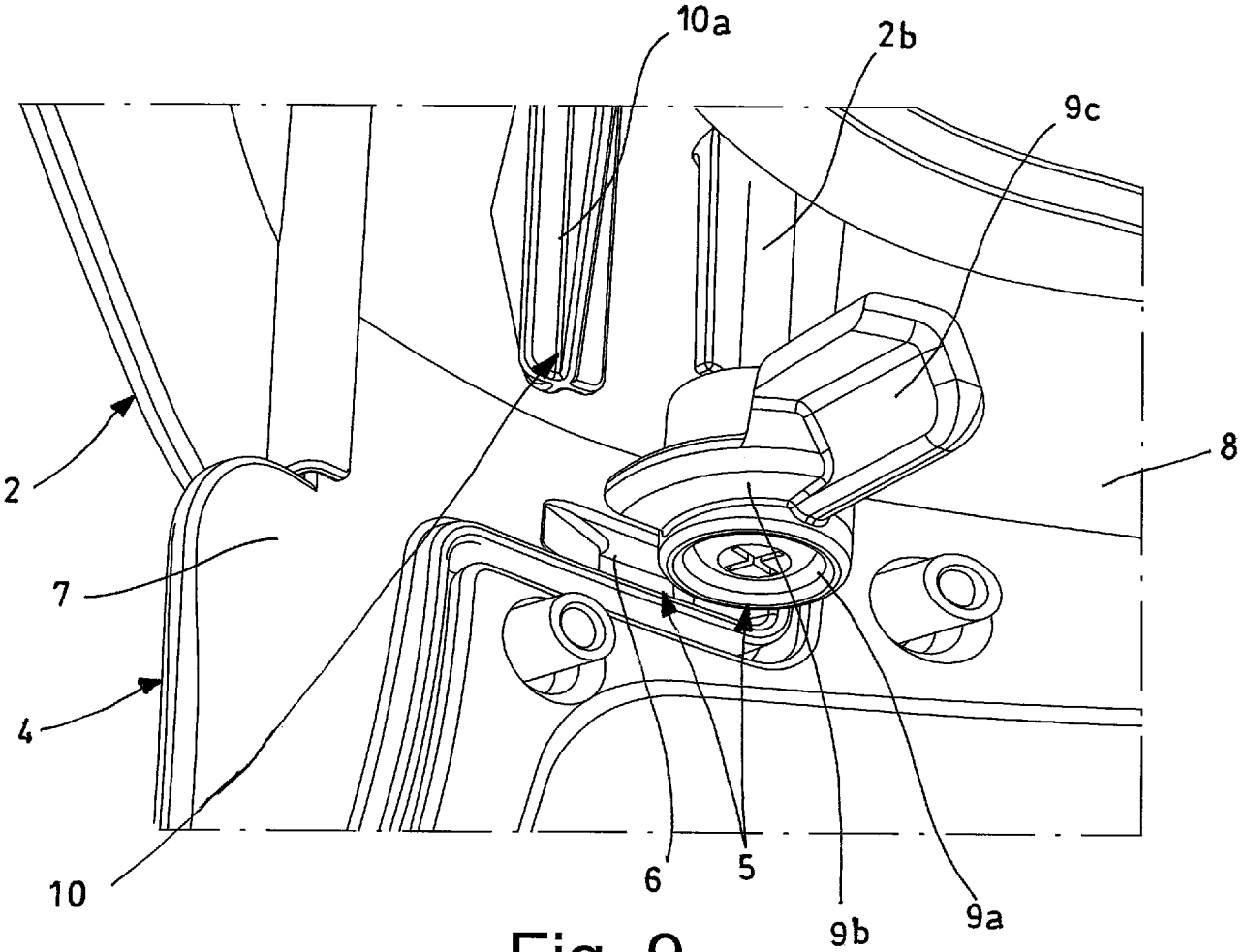
FIGS. 9 to 11 are representations of a detail of the face protection accessory of FIG. 1, illustrated in different configurations.
Figure 10:
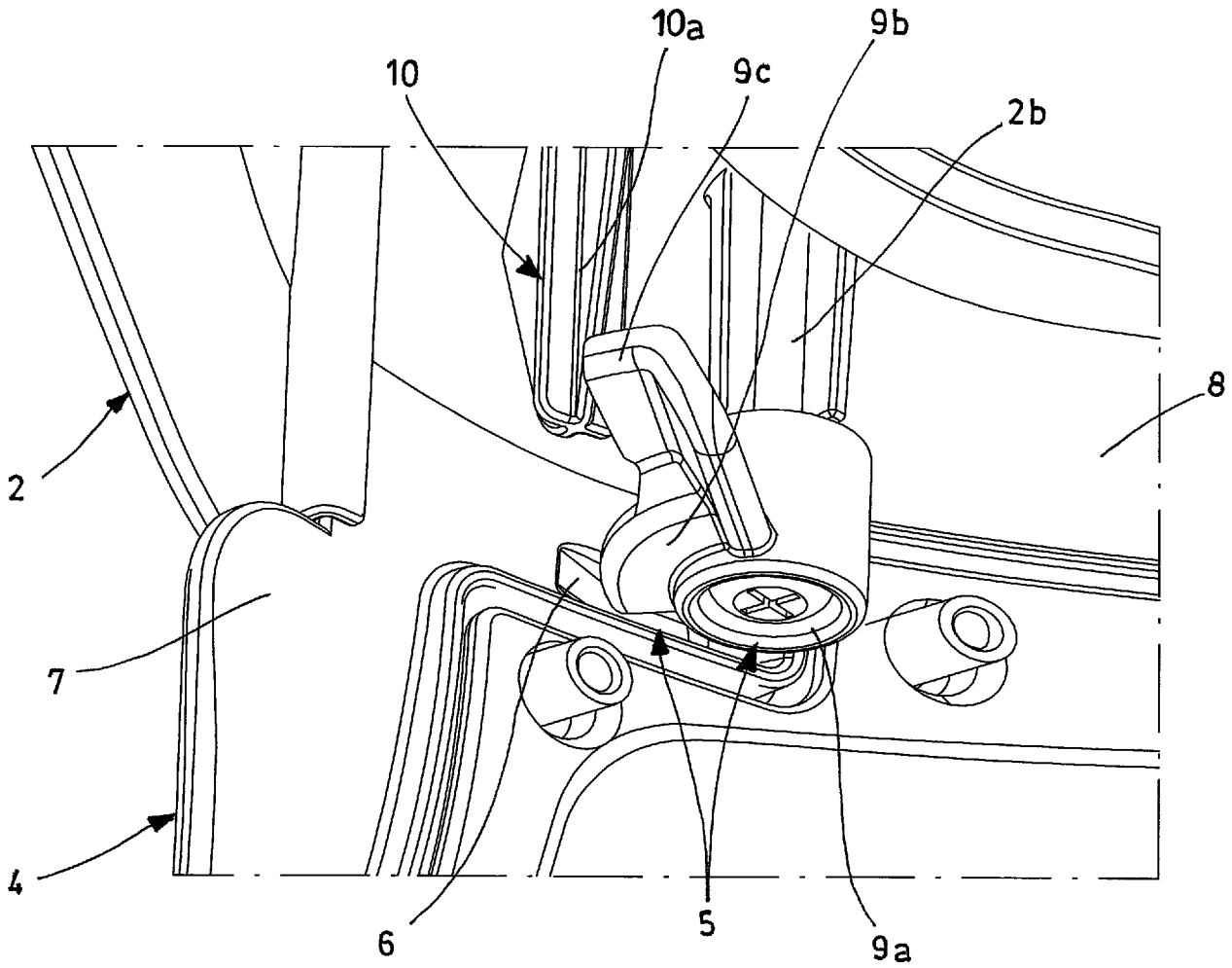

Each of the locking means 10 comprises at least one protrusion 10*a* projecting from the support structure 2 and interfering with the driving portion 9*c* of the respective coupling pin 9 at or close to the second position of the latter. Preferably, the protrusion 10*a* and the respective driving portion 9*c* interfere elastically in the second position of the respective coupling pin 9 to lock the latter in such position (FIGS. 5 *e* 11).

Advantageously the face protection accessory 1 further comprises centring means 11 (FIGS. 5, 11 and 15) interposed between the support structure 2 and the face protection structure 4 for centring the mutual engagement of the latter and allowing the correct operation of the coupling means 5.

The face protection accessory 1 further comprises at least one additional protection element 12 which can be engaged to the support structure 2 to project from the latter transversely with respect to the face protection structure 4 and to the helmet 3, acting as spacer and bumper against the accidental contact with accessories, utensils, tools or dangerous machines. The protection element 12 is provided with a plurality of coupling seats 12*a* each of which can be snap-fitted or interference-fitted by a respective coupling pin 2*c* projecting from the support structure 2, preferably from a front engagement edge 2*d* of the latter, which lies above the face protection structure 4 when it is engaged to the support structure 2.

Figure 16:
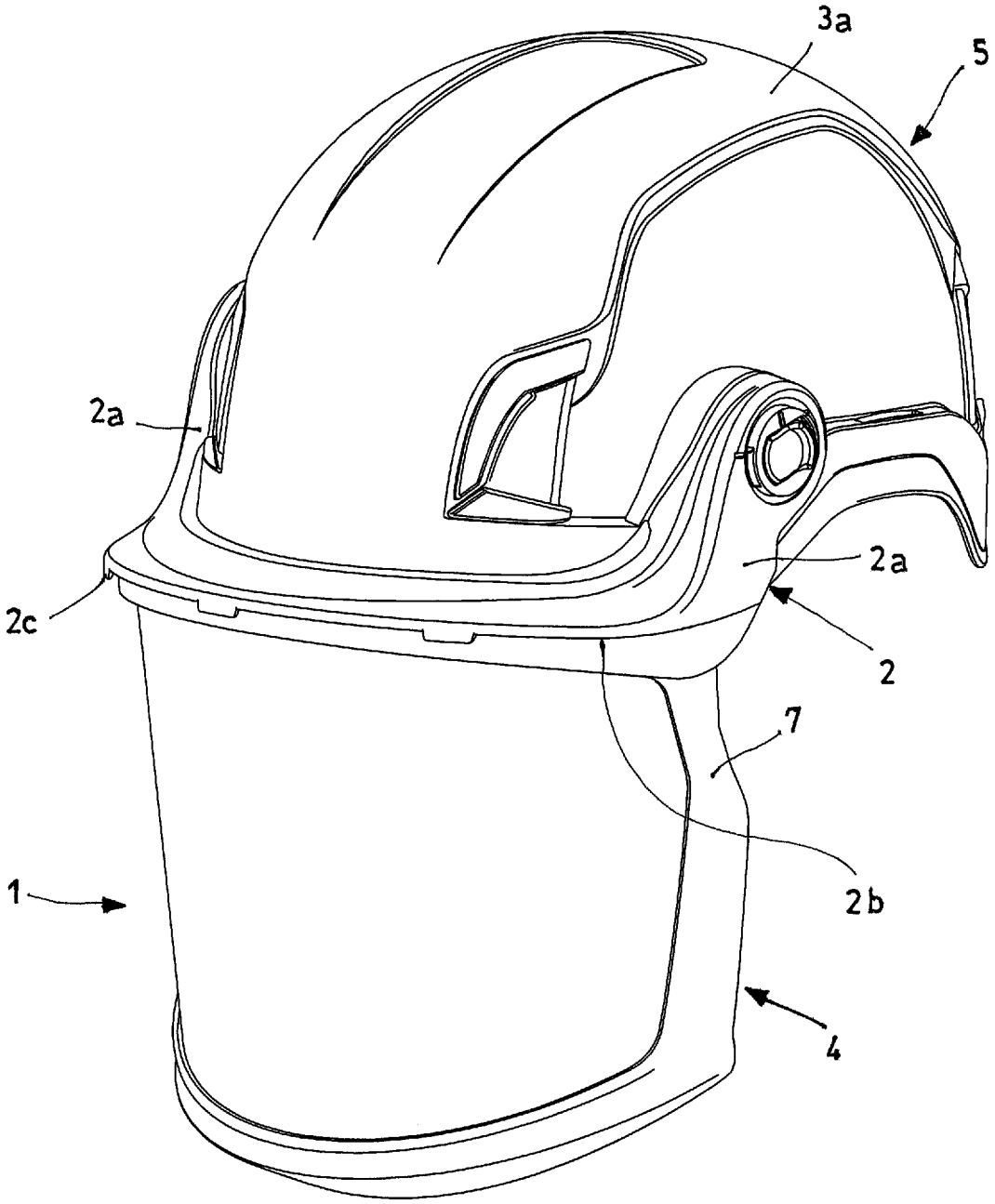
FIG. 16 is a perspective view of a helmet provided with the accessory of FIG. 1.
Figure 17:
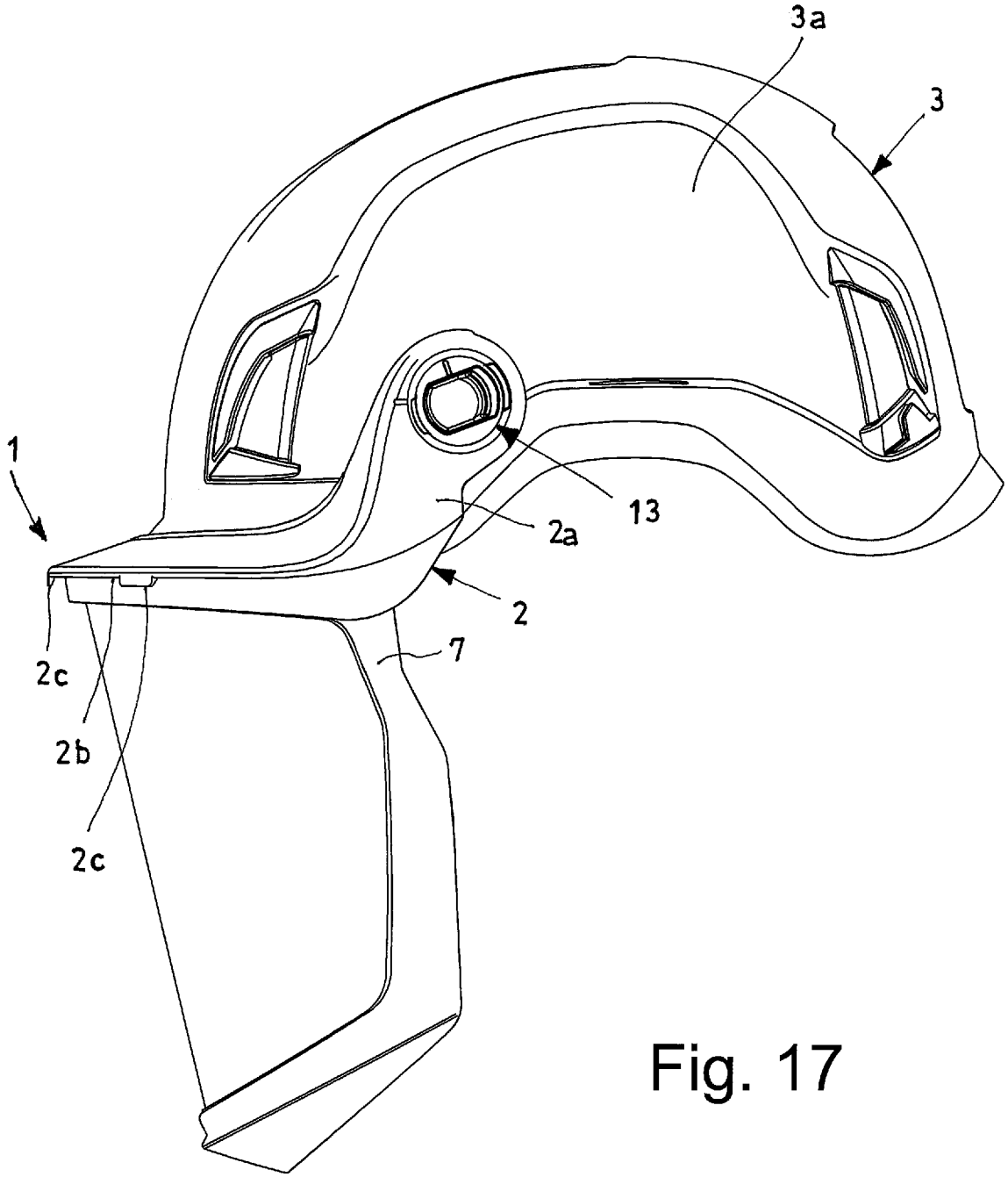
FIG. 17 is a lateral view of the helmet of FIG. 16.

As seen in FIGS. 16 and 17, the face protection accessory 4 can be mounted on a helmet 3 which has at least one convex outer surface 3*a*, at least one concave inner surface, adapted to receive a user's head in engagement, and at least two coupling and decoupling elements 13 for the connection of the engagement portions 2*a* of the support structure 2 of the above described face protection accessory 1.

Acting on the coupling and decoupling element 13 it is possible to remove the support structure 2 of the face protection accessory 1 and, thus, the latter, from the helmet 3. Acting on the other hand on the coupling pins 9 it is possible to remove the face protection structure 4 to leave the helmet 3 free or to replace it with another face protection structure having different features.

The face protection accessory and the helmet according to the present invention solve the problems observed in the known technique and achieve important advantages.

Firstly, the provision of a unique support structure that can be engaged to the helmet and on which it is possible to fix several different types of face protection structures allows a remarkable reduction of the overall encumbrances of all the required components, since each face protection structure does not have the bulky engagement portions to the helmet, since they are only provided on the support structure.

The absence of the engagement portions in each face protection structure required for the usual work activity allows to occupy a reduced encumbrance both during the transport, and the storage of the same.

The invention claimed is:

1. A face protection accessory for helmets, comprising:

at least one support structure having two engagement portions configured to couple the at least one support structure to an outer surface of a helmet;

and at least one transparent or perforated face protection structure, to allow a user wearing the helmet to see through the at least one transparent or perforated face protection structure;

wherein the at least one transparent or perforated face protection structure is configured to couple to the at least one support structure to form the face protection accessory and is removable from the at least one support structure to remove the at least one transparent or perforated face protection structure from the helmet or to replace the at least one transparent or perforated face protection structure with a different face protection structure;

wherein the face protection accessory further comprises coupling means configured to couple the at least one support structure and the at least one transparent or perforated face protection structure, the coupling means being configured to switch between a first condition congruent with a first position, in which the coupling means maintain the at least one support structure and the at least one transparent or perforated face protection structure mutually engaged thereby coupling the at least one transparent or perforated face protection structure to the at least one support structure, and a second condition congruent with a second position, in which the at least one support structure and the at least one transparent or perforated face protection structure are not mutually engaged thereby rendering separable the at least one support structure and the at least one transparent or perforated face protection structure;

wherein the coupling means comprises (i) at least two coupling seats each obtained at opposite ends of an engagement edge of the at least one transparent or perforated face protection structure, and (ii) at least two coupling pins disposed on the at least one support structure with each being moveable between the first position, in which each coupling pin is inserted into a respective coupling seat of the at least one transparent or perforated face protection structure thereby coupling the at least one transparent or perforated face protection structure to the at least one support structure, and the second position, in which each coupling pin does not engage the respective coupling seat of the at least one transparent or perforated face protection structure thereby rendering separable the at least one support structure from the at least one transparent or perforated face protection structure;

wherein each coupling pin is disposed on an interior surface of the at least one support structure and is rotatably moveable between the first position and the second position around a vertical axis substantially parallel to the interior surface of the at least one support structure;

wherein the at least two coupling pins are each moveable independently from each other;

wherein each coupling pin comprises (i) a hollow cylindrical body with an aperture sized to be fitted on a cylindrical support projecting from the at least one support structure, the hollow cylindrical body rotating on the cylindrical support of the at least one support structure about its own longitudinal axis, and (ii) a coupling portion transversely projecting from the hollow cylindrical body and circularly extending along a predetermined circular sector around the hollow cylindrical body, the coupling portion of each coupling pin of the coupling means inserting into and being removable from the coupling seat of the face protection accessory through the rotation of the hollow cylindrical body on the cylindrical support of the at least one support structure;

wherein each coupling pin of the coupling means comprises a driving portion for moving the coupling pin between the first position and the second position by the user, wherein the driving portion of each coupling pin projects transversely and radially from the hollow cylindrical body and has a contact surface for manually actuating the coupling pin between the first position and the second position by the user, the driving portion being integrally joined to a part of the coupling portion of the coupling pin at a position opposite from where the coupling portion first engages the coupling seat of the at least one transparent or perforated face protection structure when coupling pin is switched from the second position to the first position, wherein the coupling portion circularly extends along the predetermined circular sector around the hollow cylindrical body between 0° and 180°, and wherein the hollow cylindrical body and the driving portion are disposed interior of the at least one support structure and the at least one transparent or perforated face protection structure when the coupling means is in the first position.

2. The face protection accessory according to claim 1, wherein for each coupling pin of the coupling means, a corresponding locking means is provided to maintain the coupling pin in the first position thereby ensuring the at least one transparent or perforated face protection structure is coupled to the at least one support structure.

3. The face protection accessory according to claim 2, wherein each of the locking means comprises at least one protrusion projecting from the at least one support structure and interfering with the driving portion of the coupling pin at or close to the first position of the coupling pin, the protrusion and the driving portion elastically interfering with each other in the first position of the coupling pin in order to lock the driving portion in such a position.

4. The face protection accessory according to claim 1, further comprising centering means interposed between the at least one support structure and the at least one transparent or perforated face protection structure for centering mutual engagement of the at least one support structure and the at least one transparent or perforated face protection structure and allowing correct operation of the coupling means.

5. The face protection accessory according to claim 1, further comprising an additional protection element, engageable to the at least one support structure to project from the at least one support structure transversely with respect to the at least one transparent or perforated face protection structure and to the helmet, the additional protection element being provided with a plurality of coupling seats each of which is engageable in a snap-fit manner or by interference by a coupling pin projecting from the at least one support structure.

6. The face protection accessory according to claim 1, wherein the vertical axis is substantially parallel to the at least one transparent or perforated face protection structure.

7. A helmet, comprising:

at least one convex outer surface;

at least one concave inner surface, adapted to receive a user's head in engagement;

at least two coupling and decoupling elements configured to removably couple at least one accessory being a visor, a mask, a net or another face protection accessory, each engageable on a lateral portion of the outer surface of the helmet; and at least one face protection accessory engageable on the coupling and decoupling elements of the helmet; wherein the at least one face protection accessory comprises:

at least one support structure having two engagement portions configured to couple the at least one support structure to an outer surface of the helmet; and at least one transparent or perforated face protection structure, to allow a user wearing the helmet to see through the at least one transparent or perforated face protection structure;

wherein the at least one transparent or perforated face protection structure is configured to couple to the at least one support structure to form the face protection accessory and is removable from the at least one support structure to remove the at least one transparent or perforated face protection structure from the helmet or to replace the at least one transparent or perforated face protection structure with a different face protection structure;

wherein the face protection accessory further comprises coupling means configured to couple the at least one support structure and the at least one transparent or perforated face protection structure, the coupling means being configured to switch between a first condition congruent with a first position, in which the coupling means maintain the at least one support structure and the at least one transparent or perforated face protection structure mutually engaged thereby coupling the at least one transparent or perforated face protection accessory to the at least one support structure, and a second condition congruent with a second position, in which the at least one support structure and the at least one transparent or perforated face protection structure are not mutually engaged thereby rendering separable the at least one support structure from and the at least one transparent or perforated face protection structure;

wherein the coupling means comprises (i) at least two coupling seats each obtained at opposite ends of an engagement edge of the at least one transparent or perforated face protection structure, and (ii) at least two coupling pins disposed on the at least one support structure with each being moveable between the first position, in which each coupling pin is inserted into a respective coupling seat of the at least one transparent or perforated face protection structure thereby coupling the at least one transparent or perforated face protection structure to the at least one support structure, and the second position, in which each coupling pin does not engage the respective coupling seat of the at least one transparent or perforated face protection structure thereby rendering separable the at least one support structure at least one transparent or perforated face protection structure;

wherein each coupling pin is disposed on an interior surface of the at least one support structure and is rotatably moveable between the first position and the second position around a vertical axis substantially parallel to the interior surface of the at least one support structure;

wherein the at least two coupling pins are each moveable independently from each other;

wherein each coupling pin comprises (i) a hollow cylindrical body with an aperture sized to be fitted on a cylindrical support projecting from the at least one support structure, the hollow cylindrical body rotating on the cylindrical support of the at least one support structure about its own longitudinal axis, and (ii) a coupling portion transversely projecting from the hollow cylindrical body and circularly extending along a predetermined circular sector around the hollow cylindrical body, the coupling portion of each coupling pin of the coupling means inserting into and being removable from the coupling seat of the face protection accessory through the rotation of the hollow cylindrical body on the cylindrical support of the at least one support structure;

wherein each coupling pin of the coupling means comprises a driving portion for moving the coupling pin between the first position and the second position by the user, and wherein the driving portion of each coupling pin projects transversely and radially from the hollow cylindrical body and has a contact surface for manually actuating the coupling pin between the first position and the second position by the user, the driving portion being integrally joined to a part of the coupling portion of the coupling pin at a position opposite from where the coupling portion first engages the coupling seat of the at least one transparent or perforated face protection structure when the coupling pin is switched from the second position to the first position, wherein the coupling portion circularly extends along the predetermined circular sector around the hollow cylindrical body between 0° and 180°, and wherein the hollow cylindrical body and the driving portion are disposed interior of the at least one support structure and the at least one transparent or perforated face protection structure when the coupling means is in the first position.

8. The helmet according to claim 7, wherein the vertical axis is substantially parallel to the at least one transparent or perforated face protection structure.

* * * * *